United States Patent [19]

Strassle

[11] 4,348,053

[45] Sep. 7, 1982

[54] FOAM PADDED CHAIR WITH SCREW ASSEMBLY OF SEAT, BACKREST AND LEGS

[75] Inventor: Alex Strassle, Kirchberg, Switzerland

[73] Assignee: Intercollection Development SA, Kirchberg, Switzerland

[21] Appl. No.: 160,806

[22] Filed: Jun. 19, 1980

[30] Foreign Application Priority Data

Aug. 3, 1979 [CH] Switzerland ..... 7165/79

[51] Int. Cl.[3] ..... A47C 5/06

[52] U.S. Cl. ..... 297/445; 297/446; 297/452; 297/458; 297/DIG. 2

[58] Field of Search ..... 297/458, 459, 460, 446, 297/461, 452, 445, DIG. 1, DIG. 2, 443, 440

[56] References Cited

U.S. PATENT DOCUMENTS

| | | | |
|---|---|---|---|
| 2,838,100 | 6/1958 | Follows | 297/DIG. 1 |
| 2,882,958 | 4/1959 | Monroe et al. | 297/446 X |
| 3,065,030 | 11/1962 | Gegoux et al. | 297/DIG. 1 |
| 3,970,401 | 7/1976 | Lubeck | 297/DIG. 1 |
| 4,114,949 | 9/1978 | Benoit | 297/445 |
| 4,119,286 | 10/1978 | Barril | 297/440 |
| 4,304,436 | 12/1981 | Rowland | 297/445 |
| 4,318,570 | 3/1982 | Adam et al. | 297/445 |

FOREIGN PATENT DOCUMENTS

| | | | |
|---|---|---|---|
| 946988 | 5/1974 | Canada | 297/DIG. 1 |
| 919259 | 10/1954 | Fed. Rep. of Germany | 297/459 |
| 2369812 | 7/1978 | France | 297/440 |
| 477845 | 10/1969 | Switzerland . | |
| 535560 | 5/1973 | Switzerland . | |
| 566754 | 9/1975 | Switzerland . | |

*Primary Examiner*—James T. McCall

*Attorney, Agent, or Firm*—Sughrue, Mion, Zinn, Macpeak and Seas

[57] ABSTRACT

The seat 10 of a chair consists of a four piece frame 20–23, with inserts 24–27 in the corners each consisting of a tube piece cut in half lengthwise. A nut 29 is attached to each insert. A mesh grid 28 is mounted between the shanks of the frame. The entire seat with the desired contours is formed from molded polyurethane foam which pads all hard parts. The backrest 12 comprises a bent core tube 44 on which nuts 43 are attached, and given the desired shape by molded polyurethane foam. The columnar legs 11 each have an axially extending upper screw 33 which screws into the nuts 43 on the backrest tube. The legs are fastened to the seat by screws 34 extending diametrically through the legs.

10 Claims, 2 Drawing Figures

FOAM PADDED CHAIR WITH SCREW ASSEMBLY OF SEAT, BACKREST AND LEGS

Figure 1:
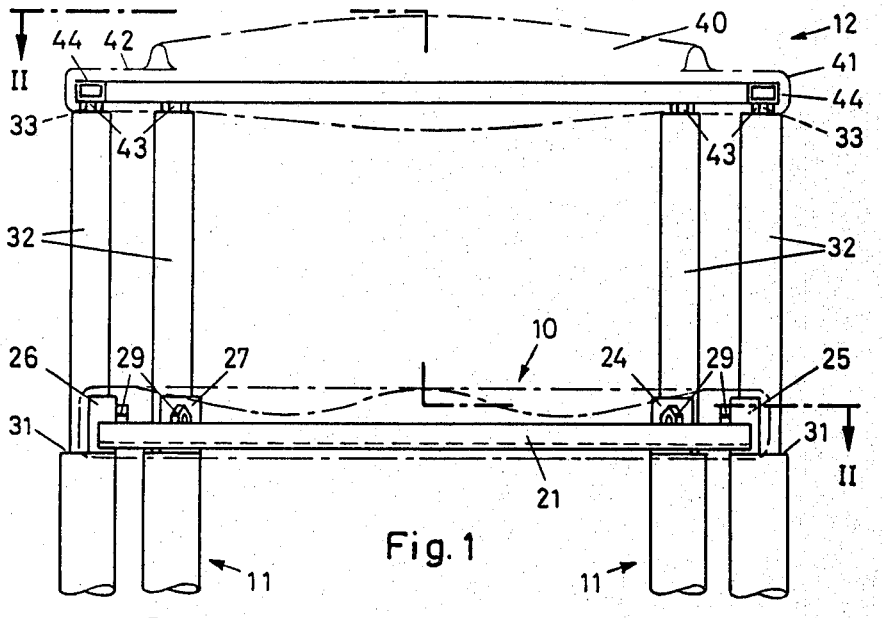

The present invention concerns a foam padded chair made from easily assembled components.

Swiss Pat. No. 535,560 teaches a process for producing seating furniture of synthetic material. The supporting elements of the seat are made from rigid plastic and the padding elements from soft foam. These supporting elements are formed in the shape of a frame and form a recess, whereby those parts of the supporting elements which border on the recess are surface compressed. It is also taught that the supporting elements be formed in modules which are put together so as to be at least partially capable of being taken apart, and that they be covered with a semi-rigid foam layer which serves on the seats and backs as a spring base and forms the subsuspension for the layers of soft foam on the other elements. Such a modular system is particularly useful in producing a large number of possible shapes, in which, according to the desired seat shape, the side pieces or backrests are variously shaped but the seat remains the same.

Swiss Pat. No. 566,754 discloses seating furniture in which the padding is attached to a frame. The padding consists of a pliable plate enclosed in a padding and coating material. Fastening elements in the form of padding buttons are provided which, in combination with a screw screwed into the shank of the padding button, serve to secure the padding to a frame.

Swiss Pat. No. 477,845 discloses a wooden chair in which the seat is formed as a completely closed, box-shaped, hollow body which is glued together from four frames, an upper and a lower plate. Corner blocks are glued into the four corners and the chair legs are secured in recesses in the corners of the hollow body and the corner blocks.

These three prior art patents show how problematical it is to produce seating furniture with the necessary stability while simultaneously reducing the cost. If, in the case of a wooden chair according to the last-mentioned patent, a box must first be glued together from precut wood parts, this would result in an almost exorbitant work outlay according to modern standards. If on the other hand, according to the first Swiss Pat. No. 535,560, practically every single element is prepared by foam coating a plastic suited to each purpose, i.e., a rigid plastic, a semirigid and a soft plastic, this can reduce the cost of producing each individual element, but correspondingly numerous forms and thus also work processes are required making this type of production of inexpensive yet stable furniture self-defeating.

Some cost reduction could be attained with Swiss Pat. No. 566,754 if the foamed plastic padding encasing the pliable plate were produced according to the teachings of Swiss Pat. No. 535,560, but the holes for the padding buttons would have to be pre-formed so that an unwanted stiffening and a danger of pressure for the formed material would result.

SUMMARY OF THE INVENTION

Accordingly, the object of the invention is to simplify the production of seating furniture and thereby drastically reduce the production costs in contrast to other furniture of this type. Beyond that, the assembly is simple and allows the furniture to be delivered in an unassembled state and the buyer to assemble it in the shortest possible time without time-consuming and costly assembly. Finally, the individual pieces are dimensioned so that they can be easily packaged, stacked in storage, and transported.

Figure 2:
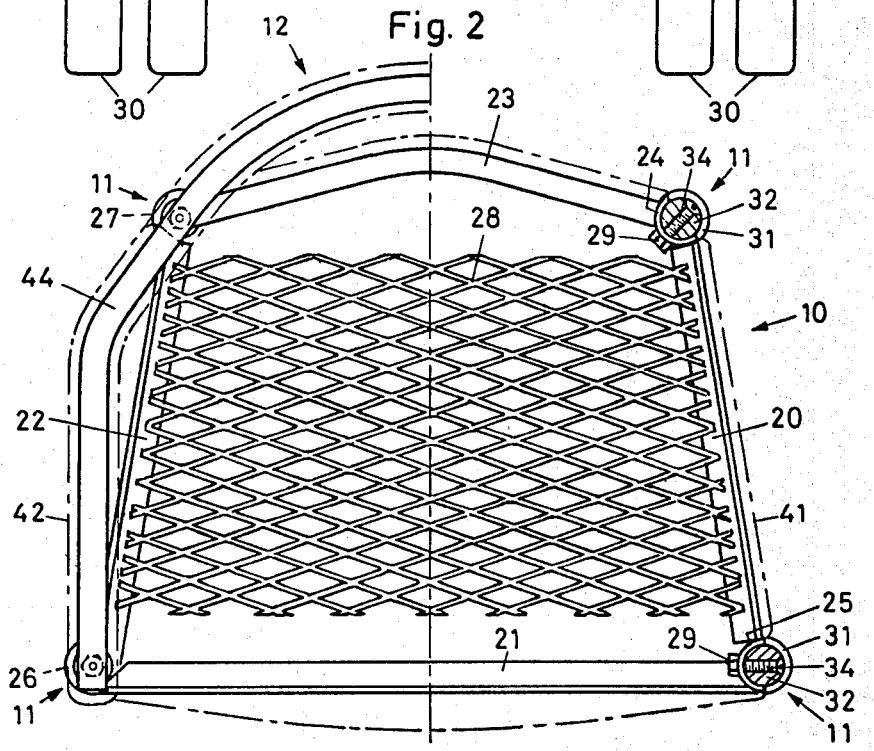

In the drawings:

FIG. 1 shows a vertical projection of a chair according to the invention, wherein the frame parts and the columnar legs are drawn with solid lines and the outline of the soft padding with chain lines, and FIG. 2 shows a cross-section of the chain taken along line II—II in FIG. 1.

The chair basically comprises a seat 10, columnar legs 11, and a back 12.

The four columnar legs 11 are cylindrical with a reduced diameter upper portion, i.e., the diameter of the cylinder is larger from the base 30 up to a height determined by the lower edge of inserts 24–27 than the upper part 32, producing a ledge 31. The columnar legs are provided with a screw 33 which is set axially into the center of the legs. Furthermore, the legs are bored diametrically through in the region where they fit onto the inserts 24–27. A screw 34 extends through these bores to secure the legs 11 to the seat 10.

The seat consists of a four piece frame with shanks 20, 21, 22, 23. In the four corners these shanks each engage an insert 24, 25, 26, 27. These eight parts are rigidly attached to each other—either welded, soldered, or glued. The two side shanks 20, 22 and the front shank 21 are angle beams, e.g., 21×21×2.5–3 of steel, aluminum or some other suitable material. The back shank 23 in this embodiment is a tube with an outer diameter of 18 mm and a wall thickness of 2 mm, also of steel or aluminum. The inserts 24–27 are sections of tubes with an interior diameter corresponding to the smaller diameter of the legs 11 at their upper ends 32. These tube sections are cut in half axially. Nuts 29 whose thread holes are aligned along a radial bore are located on the mid vertical level of the half diameter inserts. The nuts are rigidly attached to each associated insert 24–27, e.g., by welding, soldering or gluing.

A mesh grid 28 is secured to the horizontal shanks of the mutually opposite side shanks 20, 22.

The seat 10 is completed by placing the frame with the mesh grid in a pour mold where it is formed into a seat with soft foam polyurethane shown in outline by the chain lines, so that all of the hard parts are encased with polyurethane foam extending inwardly to the inner surface of the half cylindrical inserts 24–27. By the use of foamed polyurethane the seat is selfskinned. Any further covering material may therefore be omitted to thus reduce the cost.

The backrest 12 is also produced in a similar manner. In the example shown the backrest extends on both sides to the front and forms armrests 41, 42. The core of the back 12 consists of a rectangular tube 44 of steel or aluminum 20×16×2. Nuts 43 are mounted above the four corners of the seat, and are rigidly fastened to the rectangular tube by welding or soldering. The screws 33 of the legs are screwed into these nuts 43.

The backrest 12 is completed by placing the shaped rectangular tube 44 with its nuts 43 in place into a pour mold so that the under surfaces of the nuts lie on supports and thus cannot be covered by foam. The backrest is also given the soft polyurethane foam contour as shown by chain lines in the drawing. Here too, as with the seat 10, all edges with the exception of the nut surfaces are encased in a foam padding.

An arm chair with a backrest and armrests is used here as an embodiment. Of course, a normal chair with only a backrest or a stool without a backrest could also be produced in the same way.

With a normal chair the backrest 12 would be only as wide as the space between the two rear legs. The front legs would have to be cut off at the height of the upper end surface of the inserts 25, 26, and a single front leg could also be provided. Correspondingly, in the case of a stool without a backrest, the two rear legs would have to be cut off at a corresponding height above the inserts 24, 27.

A chair produced according to the invention could easily be transported unassembled with four individual legs 11, a seat 10 and, if need be, a backrest 12, and then be assembled. This would require the screws 33 in the legs to first be screwed into the nuts 43 of the backrest. The bores in the legs are then aligned with the nuts 29 on the seat frame, and the seat 10 is placed on the ledge 31 on the legs. By tightening the four screws 34 a stable chair is assembled of which all the parts can be produced serially and inexpensively.

What is claimed is:

1. A chair including rigid supporting elements and soft foam padding, comprising: a seat (10) including a rigid frame (20–23), a plurality of inserts (24–27) rigidly mounted on said frame for individually securing an equal plurality of columnar legs (11) thereto, said inserts each having a concave configuration which mates with and matches a corresponding covex surface of an associated leg and having a fastening element (29) secured thereto for rigidly mounting said associated leg, a rigid planar seat core (28) inserted into said frame, a first molded foam padding encasing the frame and the seat core on all sides with the exception of outwardly facing surfaces of said inserts, rear ones of the columnar legs extending above the seat, a backrest (12) comprising a rigid frame (44) having fastener elements (43) rigidly secured thereto for fastening to abutting ends of the extended columnar legs, and a second molded foam padding encasing the backrest frame on all sides with the exception of downwardly facing surfaces of the fastener elements.

2. A chair according to claim 1, wherein the seat frame comprises right angle beams rigidly connected to the columnar leg fastening inserts.

3. A chair according to claim 3, wherein the seat frame below the backrest comprises a tubular member (23).

4. A chair according to claim 3, wherein the columnar legs are cylindrical and the inserts are made of tube sections cut in half along their longitudinal axes, said inserts being attached to the seat frame on their convex sides and having nuts on their convex sides for screw fastening with the legs.

5. A chair according to any one of claims 1–4, wherein the seat core is a mesh grid.

6. A chair according to claim 5, wherein the mesh grid lies on side members of the seat frame and is offset from the front and back of the frame.

7. A chair according to claim 6, wherein the first molded foam seat padding is formed anatomically and a swelling is formed at least in front of a front seat frame member.

8. A chair according to claim 1, wherein the backrest frame is made of a hollow rectangular tube on whose bottom outer surface nuts are secured for attaching the columnar legs.

9. A chair according to claim 8, wherein there are four columnar legs extended to provide attachment for a unitary backrest and armrest.

10. A chair according to claim 8, wherein the diameter of the columnar legs is greater below the seat than above to define a ledge (31) on which the lower edge of the inserts rests.

* * * * *